United States Patent [19]

Inada et al.

[11] 4,334,837

[45] Jun. 15, 1982

[54] DIAPHRAGM AIR PUMP ASSEMBLY

[75] Inventors: Masami Inada, Kariya; Yasuhiro Kawabata, Anjo; Noriyoshi Shibata, Nagoya, all of Japan

[73] Assignee: Aisin Seiki Kabushiki Kaisha, Kariya, Japan

[21] Appl. No.: 113,238

[22] Filed: Jan. 17, 1980

[30] Foreign Application Priority Data

Jan. 19, 1979 [JP] Japan ..... 54/5225

[51] Int. Cl.[3] ..... F04B 43/06; F01L 25/02

[52] U.S. Cl. ..... 417/393; 91/306; 91/313

[58] Field of Search ..... 417/393, 396; 91/305, 91/306, 313, 341 R

[56] References Cited

U.S. PATENT DOCUMENTS

| | | | |
|---|---|---|---|
| 1,161,787 | 11/1915 | Nickol | 417/393 |
| 1,920,014 | 7/1933 | Horton et al. | 417/393 |
| 3,282,167 | 11/1966 | McKenzie | 417/397 X |
| 3,943,823 | 3/1976 | Tammy | 91/323 X |

*Primary Examiner*—Leonard E. Smith

*Attorney, Agent, or Firm*—Finnegan, Henderson, Farabow & Garrett

[57] ABSTRACT

A diaphragm air pump assembly pneumatically associated with a vacuum source and an atmospheric air source, comprises two diaphragms interconnected by a vertically extending rod to define two vacuum operational chambers and two pump chambers, two valves for controlling the alternative admission of vacuum to the vacuum operational chambers, and two normally closed valves operable in response to movement of the diaphragms in unison with the rod, each of two corresponding constituent parts being disposed and mounted in a symmetrical arrangement with respect to the central axis of the pump assembly. When the diaphragms are moved in one direction, one of two normally closed valves is opened to admit the vacuum into one of two vacuum operational chambers while admitting atmospheric air into the other vacuum operational chamber. When the diaphragms are moved in the other direction the other normally closed valve is opened to admit the vacuum into the other vacuum operational chamber while admitting atmospheric air into one of two vacuum operational chambers. Thus two pump chambers are alternatively compressed to effect the pumping operation.

8 Claims, 1 Drawing Figure

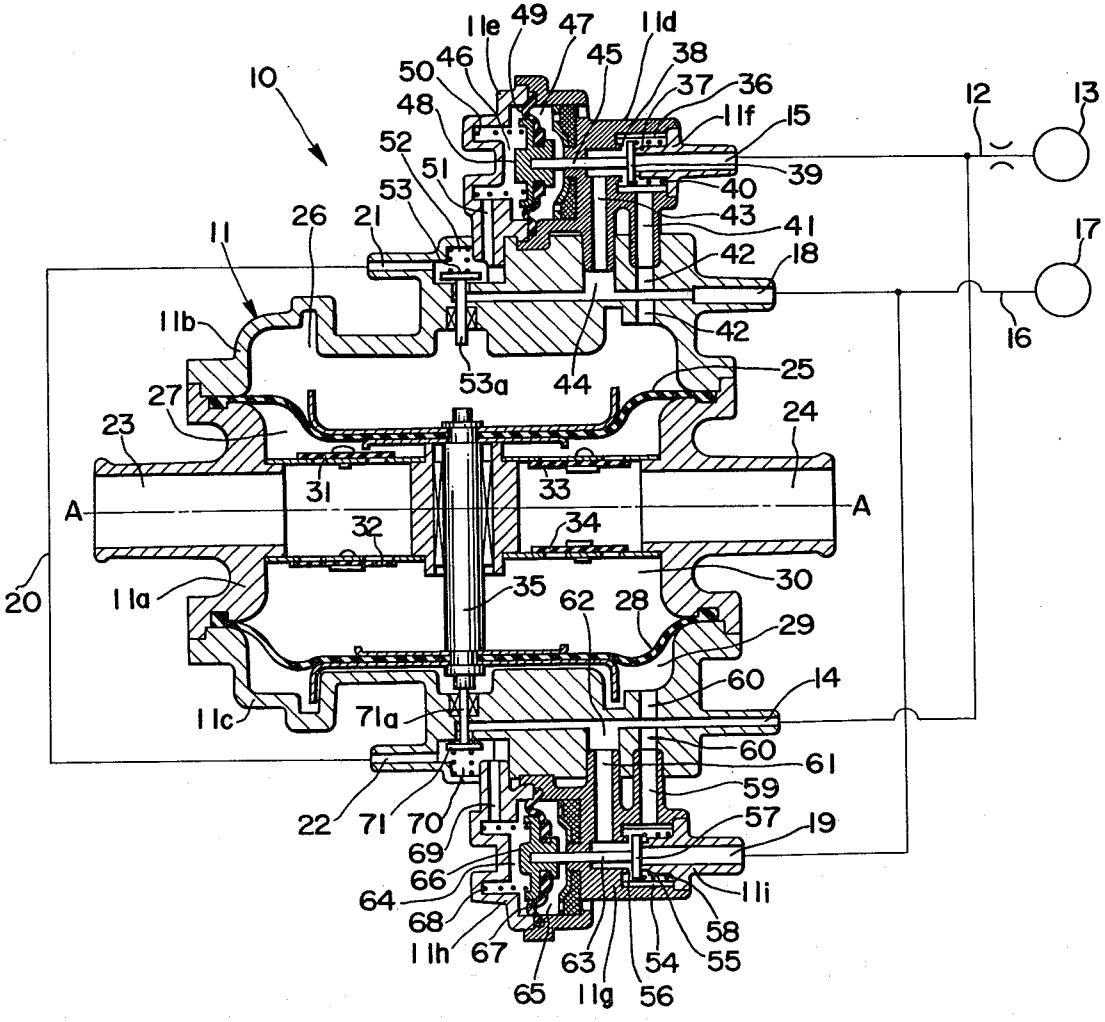
10
11
11a
11b
11c
11d
11e
11f
11g
11h
11i
12
13
14
15
16
17
18
19
20
21
22
23
24
25
26
27
28
29
30
31
32
33
34
35
36
37
38
39
40
41
42
43
44
45
46
47
48
49
50
51
52
53
53a
57
58
59
60
61
62
63
64
65
66
67
68
69
70
71
71a
A

DIAPHRAGM AIR PUMP ASSEMBLY

BACKGROUND OF THE INVENTION

This invention relates to an air pump assembly and more particularly to a diaphragm air pump assembly having diaphragm means actuated due to vacuum-air pressure differential.

It is well-known to effect the pumping operation by use of a vane air pump assembly in which a plurality of vanes are disposed in a rotor rotational within the cam ring driven by an engine through a pulley.

According to such a conventional vane pump assembly, however, the engine load is increased, the pump assembly is of rather considerable weight and the constituent parts of the pump assembly are required to be manufactured with strict accuracy.

Therefore, there have been proposed various types of pump assemblies irrespective of the drawbacks of the vane pump assembly mentioned above. However, even such an improved pump assembly is not sufficient in view of manufacturing or assembling processes due to complicated construction or configuration thereof.

SUMMARY OF THE INVENTION

It is, accordingly, one of the objects of the invention to provide a diaphragm air pump assembly which does not increase the engine load and pump assembly weight.

It is another object of the invention to provide a diaphragm air pump assembly which is simple in structure and easy in assembling.

Other important objects will become apparent to those skilled in this art as the disclosure is more fully made.

Briefly, these objects may be attained by a diaphragm air pump assembly which comprises two diaphragms interconnected by a rod, two valve means to control the alternative admission of vacuum to two diaphragms, two normally closed valve means operable in response to movement of the diaphragms, these constituent members being disposed and mounted in a symmetrical arrangement with respect to the central axis of the pump assembly.

BRIEF DESCRIPTION OF THE DRAWINGS

The single FIGURE is a longitudinal section of one embodiment of a diaphragm air pump assembly in accordance with the invention.

DETAILED EXPLANATION OF A PREFERRED EMBODIMENT

Referring now to the sole FIGURE, there is generally illustrated a diaphragm air pump assembly 10 comprising a body 11 which is constituted by nine body elements 11*a*–11*i*.

A third body element 11*c* and a sixth body element 11*f* are provided with ports 14 and 15 respectively, each port being pneumatically connected to a vacuum source 13 such as an engine intake manifold via pipe 12. A second body element 11*b* and a ninth body element 11*i* are provided with ports 18 and 19, respectively, each port being pneumatically connected to an air cleaner 17 via pipe 16. The second body element 11*b* and the third body element 11*c* are provided with ports 21 and 22, respectively, both of the ports 21 and 22 being pneumatically connected to each other via pipe 20. A first body element 11*a* is provided with an air inlet port 23 and an air autlet port 24.

The interior, defined by the first and the second body elements 11*a* and 11*b*, is divided into an upper vacuum operational chamber 26 and a lower pump chamber 27 by a diaphragm 25 the outer periphery of which is air-tightly fixed by the body elements 11*a* and 11*b*. Similarly, the interior, defined by the first and the third body elements 11*a* and 11*c*, is divided into a lower vacuum operational chamber 29 and an upper pump chamber 30 by a diaphragm 28 the outer periphery of which is air-tightly fixed by the elements 11*a* and 11*c*.

Both pump chambers 27 and 30 are in pneumatic communication with the air inlet port 23 through one way check valves 31 and 32 respectively, mounted on the first body element 11*a* as well as with the air outlet port 24 through one way check valve 33 and 34, respectively.

Both diaphragms 25 and 28 are connected to each other by a vertically extending rod 35 reciprocally and air-tight mounted on the first body element 11*a*.

Within an interior chamber 36, defined by a fourth body element 11*d* and the sixth body element 11*f* a valve plate 39 is mounted transversely reciprocal which is normally urged to seat on a valve seat 38 of the fourth body element 11*d* due to the exerting force of spring 40, but may be seated on a valve seat 37 of the sixth body element 11*f* upon operation. The chamber 36 is in normal communication with the vacuum chamber 26 through passages 41 and 42 provided on the fourth and second body elements 11*d* and 11*b*, respectively. The chamber 36 is also in communication with the atmospheric port 18 through passages 43 and 44 insofar as the valve plate 39 is seated on the seat 37 as illustrated.

The interior defined by the forth body element 11*d* and a fifth body element 11*e* is divided into a variable pressure chamber 46 and an atmospheric pressure chamber 47 normally supplied with atmospheric air by a smaller diameter diaphragm 49 and a piston 48 secured thereto to which a plunger 45 is fixed thereby to bring the valve plate 39 in seating engagement with the seat 37. Within the variable pressure chamber 46 is disposed a spring 50 the exerting force of which is greater than that of the sprigg 40.

The variable pressure chamber 46 is in normal communication with the port 21 through a passage 51 provided on the fifth body element 11*e* and a chamber 52 constituted in the second body element 11*b* within which a normally closed valve 53 is mounted to control the atmospheric communication between the chamber 52 and the passage 44. The normally closed valve 53 is formed with a rod portion 53*a* arranged coaxially to the vertically extending rod 35 and thereby opened upon engagement of the rod portion 53*a* with the rod 35 due to upward movement thereof in unison with the diaphragms 25 and 28.

Similarly, within an interior chamber 54 defined by a seventh body element 11*g* and the ninth body element 11*i* is transversely reciprocably mounted a valve plate 57 which is normally urged to seat on a valve seat 56 provided on the seventh body element 11*g* by the exerting force of a spring 58, but may be seated on a valve seat 55 provided on the ninth body element 11*i* upon operation. The chamber 54 is in normal communication with the vacuum operational chamber 29 through passages 59 and 60 provided on the ninth and the third body elements 11*i* and 11*c*, respectively, and is also in communication with the port 14 through passages 61 and 62 provided on the ninth and the third body elements 11*i* and 11*c*, respectively insofar as the valve plate 57 is seated on the seat 55 as illustrated.

The interior defined by the seventh body element 11*g* and an eighth body element 11*h* is divided into a variable pressure chamber 64 and an atmospheric pressure chamber 65 normally supplied with atmospheric air by a smaller diameter diaphragm 67 and a piston 66 fixed thereto to which a plunger 63 is fixed thereby to bring the valve plate 57 to seating engagement with the seat 55. Within the variable pressure chamber 64 is disposed a spring 68 the exerting force of which is greater than that of the spring 58.

The variable pressure chamber 64 is in normal communication with the port 22 through a passage 69 of the eighth body element 11*h* and a chamber 70 constituted in the third body element 11*c* in which a normally closed valve 71 is mounted to control the pneumatic communication between the chamber 70 and the passage 62. The normally closed valve 71 is provided with a rod portion 71*a* extending coaxially to the rod 35 and is opened upon engagement of the rod portion 71*a* with the rod 35 due to the downward movement thereof in unison with the diaphragms 25 and 28.

In summary, the pump assembly 10 is of a symmetrical construction with respect to a transverse central axis A—A as shown in the drawing.

In the illustrated condition wherein no vacuum is admitted into the pipe 12 from the vacuum source 13, the diaphragm air pump assembly 10 is in its rest or non-operational position. Therefore, the normally closed valves 53 and 71 are in the closed positions thereof to thereby seat the valve plates 39 and 57 on the valve seats 37 and 55 due to the biasing force of the springs 50 and 68. As a result, the vacuum operational chamber 26 is supplied with atmospheric air through passages 42 and 41, chamber 36, passages 43 and 44, port 18, pipe 16 and air cleaner 17, while the vacuum operational chamber 29 is connected to the pipe 12 through passages 60 and 59, chamber 54, passages 61 and 62 and port 14.

Upon generation of vacuum at the vacuum source 13, the vacuum operational chamber 29 is supplied with a vacuum thereby moving the diaphragms 25 and 28 in unison with the rod 35 in the downward direction due to pressure differential between two vacuum operational chambers 26 and 29. The rod portion 71*a* of the normally closed valve 71 is in abutment against the rod 35 to open the valve 71 simultaneously with the downward movement of the rod 35.

Thus, the vacuum in the passage 62 is admitted into the variable pressure chamber 64 via the chamber 70 and the passage 69, and at the same time to the variable pressure chamber 46 via chamber 70, port 22, pipe 20, port 21, chamber 52 and passage 51. As a result, the piston 66 is moved left due to pressure differential between two chambers 64 and 65 to permit the valve plate 57 to seat on the valve seat 56, thereby admitting atmospheric air into the vacuum operational chamber 29 through passages 60 and 59, chamber 54, port 19, pipe 16 and air cleaner 17.

Simultaneously, the piston 48 is moved leftward due to the pressure difference between two chambers 46 and 47 to bring the valve plate 39 into seating abutment with the valve seat 37 thereby isolating the vacuum operational chamber 26 from atmospheric pressure and supplying the chamber 26 with vacuum via the passages 42 and 41, chamber 36, port 15, pipe 12 and vacuum source 13. Thus, the diaphragms 25 and 28 in unison with the rod 35 are initiated to move in the upward direction due to pressure differential between two vacuum operational chambers 26 and 29. As a consequence, the capacity in the pump chamber 30 is decreased to compress the air contained therein which is then exhausted into the outlet port 24 through the one-way check valve 34 while the capacity in the pump chamber 27 is increased to absorb the air therein from the inlet port 23 through the one way check valve 27.

The upward movement of the diaphragms 25 and 28 in unison with the rod 35 will allow the closure of the normally closed valve 71 to capture the vacuum in the variable pressure chambers 46 and 64.

When the rod portion 53*a* of the normally closed valve 53 is brought into abutment with the rod 35, the valve 53 is opened to admit the air in the chamber 52 via passage 44. The air in the chamber 52 is then supplied to the variable pressure chamber 46 through passage 51 and to the variable pressure chamber 64 through port 21, pipe 20, port 22, chamber 70 and passage 69. The pistons 48 and 66 are, accordingly, moved rightward due to the biasing force of springs 50 and 68 with the result that the valve plate 39 is seated on the valve seat 37 while the valve plate 57 is seated on the valve seat 55. Therefore, the vacuum operational chamber 26 is again supplied with atmospheric air whilst the vacuum operational chamber 29 is again supplied with vacuum, to thereby move the diaphragms 25 and 28 in unison with the rod 35 in the downward direction. The capacity in the pump chamber 27 is decreased to compress the air contained therein which is then exhausted into the outlet port 24 through the one-way check valve 33 while the capacity in the pump chamber 30 is increased to absorb the air therein from the inlet port 23 through the one way check valve 32. The normally closed valve 53 is brought into its closed position in accordance with the downward movement of the diaphragms 25 and 28 and the rod 35.

The vertical reciprocation of the diaphragms 25 and 28 in unison with the rod 35 is periodically repeated to alternatively absorb or compress the air in the pump chambers 27 and 30.

While the preferred embodiment of the invention has been explained in some detail, it should be regarded as an illustration or example rather than as a limitation or restriction of the invention, since various changes in the construction, combination, and arrangement of the parts may be made without departing from the spirit and scope of the invention. For instance, the pipes 12 and 16 may be connected to the air cleaner 17 and the vacuum source 13, respectively, so that the vacuum operational chamber 26 is supplied with vacuum while the vacuum operational chamber 29 is supplied with atmospheric air upon generation of vacuum, thereby moving the diaphragms 25 and 28 in unison with the rod 35 in the upward direction.

We claim:

1. A diaphragm air pump assembly adapted for use and association with a vacuum source and an atmospheric air source, comprising in combination:

a body, axially aligned inlet and outlet ports in said body and defining a central axis of said body, first and second diaphragms for defining first and second pump chambers and first and second vacuum operational chambers in said body, a rod interconnecting said first and second diaphragms to move in unison therewith, said diaphragms and said rod moving transversely of said central axis, first and second valve means mounted on said body, each said valve means including a port connected to said vacuum source, a port connected to said atmospheric air pressure, and a passage allowing alternative admission of vacuum and atmospheric air to said first and second vacuum operational chambers by communicating one of said ports with said passage, each of said valve means being disposed in symmetrical arrangement with respect to the central axis of said body, first and second actuating means symmetrically mounted on said body with respect to said central axis, each of said actuating means including a variable pressure chamber, an atmospheric pressure chamber in normal communication with atmospheric air, and a reciprocal member operatively connected to each of said first and second valve means in accordance with pressure differential between said variable pressure chamber and said atmospheric pressure chamber, thereby admitting a vacuum alternatively to said first and second vacuum operational chambers, and passage means connected at one end to said vacuum source and at the other end to said atmospheric air source, said passage means including first and second normally closed valves mounted on said body to control alternative admission of vacuum and atmospheric air into said variable pressure chambers, said first and second normally closed valves being symmetrically disposed with respect to the central axis of said body and actuated in response to movement of said first and second diaphragms in unison with said rod, whereby the alternative admission of vacuum into said first and second vacuum operational chambers causes the alternative decrease of capacity in said first and second pump chambers to affect the pumping operation due to reciprocation of said first and second diaphragms in unison with said rod.

2. A diaphragm air pump assembly as set forth in claim 1, wherein said first and second normally closed valves include rod portions brought into alternating abutment against said rod, each of said rod portions being disposed in coaxial relationship with said rod.

3. A diaphragm air pump assembly as set forth in claim 1, wherein each of said first and second pump chambers includes a first one-way valve for exhausting air and a second one-way check valve for absorbing air.

4. A diaphragm air pump assembly as set forth in claim 1, wherein said reciprocal member of each of said first and second actuating means includes a smaller diameter diaphragm, a piston fixed thereto, a spring disposed in said variable pressure chamber, and a plunger secured to said piston at one end thereof and engaged with each of said first and second valves at the other end thereof.

5. A diaphragm air pump assembly as set forth in claim 4, wherein each of said first and second valves includes a valve plate engaged with said plunger and normally urged by a helical spring to seat on a first valve seat while urged to seat on a second valve seat by said plunger.

6. A diaphragm air pump assembly as set forth in claim 1, wherein said body includes a first body element formed with an air inlet port and an air outlet port at each end thereof and for guiding the reciprocation of said vertically extending rod.

7. A diaphragm air pump assembly as set forth in claim 6, wherein said body further includes a second body element fixed to said first body element to air-tightly hold the outer periphery of said first diaphragm and a third body element fixed to said first body element to air-tightly hold the outer periphery of said second diaphragm, said second and third body elements are symmetrically disposed and provided with first ports in communication with said atmospheric air source and said vacuum source, respectively, and second ports interconnected with each other thereby forming a part of said passage means.

8. A diaphragm air pump assembly as set forth in claim 7, wherein said first normally closed valve is interposed between said atmospheric air source and said second port of said second body element is opened when said first and second diaphragms are moved in one direction thereby admitting atmospheric air into said first vacuum operational chamber while admitting vacuum into said second vacuum operational chamber, and said second normally closed valve is interposed between said vacuum source and said second port of said third body element is opened when said first and second diaphragms are moved in the other direction thereby admitting atmospheric air into said second vacuum operational chamber while admitting into said first vacuum operational chamber.

* * * * *

UNITED STATES PATENT AND TRADEMARK OFFICE

CERTIFICATE OF CORRECTION

PATENT NO. : 4,334,837

DATED : June 15, 1982

INVENTOR(S) : MASAMI INADA et al.

It is certified that error appears in the above—identified patent and that said Letters Patent is hereby corrected as shown below:

Column 4, line 61, "and" (first occurrence) should read --in--;

Column 6, line 48, after "admitting" insert --vacuum--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*